United States Patent [19]

Arbeeny

[11] 4,412,114

[45] Oct. 25, 1983

[54] ELECTRICAL SWITCH

[76] Inventor: John Arbeeny, 6011 Craig St., Springfield, Va. 22150

[21] Appl. No.: 354,316

[22] Filed: Mar. 3, 1982

[51] Int. Cl.[3] ..... H01H 35/00

[52] U.S. Cl. ..... 200/61.08

[58] Field of Search ..... 200/61.08, 61.4; 340/550

[56] References Cited

U.S. PATENT DOCUMENTS

| | | | |
|---|---|---|---|
| 587,931 | 8/1897 | Coleman | 340/550 |
| 2,419,828 | 4/1947 | Ferris | 200/61.08 |
| 3,260,810 | 7/1966 | Alston et al. | 200/61.08 |
| 3,269,987 | 8/1966 | Alston et al. | 200/61.08 |
| 3,477,019 | 11/1969 | Hartmann | 200/61.08 X |
| 3,859,482 | 1/1975 | Matsui et al. | 200/61.08 |

*Primary Examiner*—J. R. Scott

*Attorney, Agent, or Firm*—Neil K. Nydegger; Arthur I. Spechler; Werten F. W. Bellamy

[57] ABSTRACT

A normally open laminated electrical switch comprises a sandwich of two electrically conductive sheets on opposite sides of, and separated by, a thin layer of insulation. Upon rupture or discontinuity of the thin insulative layer, the electrically conductive sheets are adapted to contact each other and to close the switch.

6 Claims, 4 Drawing Figures

ELECTRICAL SWITCH

The invention described herein may be manufactured, used, and licensed by or for the Government for governmental purposes without the payment to me of any royalty thereon.

BACKGROUND OF THE INVENTION

This invention relates generally to an electrical switch. More particularly, the invention relates to a continuous sheet which comprises a sandwich of two electrically conductive layers separated by electrical insulation. Any rupture of the sheet, or discontinuity in the insulation, causes the conductors to contact each other and to complete an electrical circuit in which the conductors may be connected. The present invention is particularly, though not exclusively, useful as a switch for electrically detonating certain mulitary land mines, for detecting damage to predefined surfaces, and for sensing the penetration of an identified barrier.

DESCRIPTION OF THE PRIOR ART

Land mines, buried in the ground, have been employed against tanks, vehicles and personnel in all recent wars. According to doctrine, land mines can be very effective for denying terrain to the enemy or slowing his advance through a particular area. Once disarmed, however, the land mine is useless. Therefore, a mine to be effective for its intended purpose must not only be difficult to find, it must also be difficult to disarm.

Among the more well-known presently-available means for finding mines are the metallic and void detectors. Such detectors, however, are not always effective in differentiating mines from other objects which may be embedded in the ground. Thus, once an object has been found, there is still the need to identify it as a mine. Typically, the quickest, easiest, and most frequently used method for accomplishing this task has been with the use of a probe. When used to identify an object, a probe, such as a stick or bayonet, is thrust into the ground until contact with the object is made. Several such thrusts in the general area is generally sufficient to identify the object as to size and shape and to determine whether excavation and disarmament is necessary.

Heretofore, due to the configuration and techniques for employment of mines, a probe could be used for such purposes with impunity and without fear of detonating the mine. Thus, there is a need to frustrate this probing tactic by establishing a separate barrier around a buried mine which, when breached, would detonate the mine. An electrical switch, structured as a continuum over the area of the desired barrier, could easily be associated with the mine to accomplish this purpose.

In addition to the specific need discussed above, there are other instances when a continuum structured electrical switch would be useful. More specifically, a switch capable of activating signal circuitry whenever concentrated activity occurs at a point within an identified area is desired. Such a switch would be very useful when used in conjunction with a damage assessment device or an alarm. This observation comes from the recognition that it is often desirable to know whether an otherwise inaccessible structure has suffered damage or an unseen barrier has been breached. To list but a few of the many examples wherein such knowledge may be of paramount importance, one need only consider fuel cells, pressurized compartments, supports, panels, sheets and containers and the many associations in which such structures are used.

Depending on the use and location of a structure, the mere fact damage has occurred may be significant. And, this may be so even though the damage is minimal or has not affected the operation of the structure. Also, as in an alarm system, the mere fact a particularly defined barrier has been penetrated will be of great significance. In either of these circumstances, it is desirable to detect or sense the smallest particle capable of causing the damage or passing through the barrier.

Previous devices for indicating damage have included circuits which generally respond to electrical surges, temperature fluctuations, and pressure changes. These devices, however, are not necessarily able to detect or sense the passage of an article through a particular predetermined barrier. In the past, barrier switches employed to meet this need have been generally structured as a grid. Inherent in such a configuration has been the presense of voids through which it is possible for an article to pass undetected. Thus, they may not detect some damage. Also, where such a grid incorporates overlapping insulated wires, relative motion between the wires can cause wear and fatigue in the insulation. The problem here is that such wear and fatigue will allow contact between the respective conductors and thereby cause a premature and unwanted closure of the circuit. There is, therefore, a need for a barrier switch structured as a continuum which will extend completely over a desired area with minimized danger of premature closure. Additionally, it is desirable, but not essential, that such a switch be flexible, durable, light-weight, and low-cost.

SUMMARY OF THE INVENTION

A preferred embodiment of the invention, deceptive in its simplicity, is merely a laminated sheet which consists essentially of a sandwich of two conductive layers separated by an insulative layer. Upon rupture of the sheet, or discontinuity in the insulative layer, the two conductive layers make contact and thereby close the switch. If in an electrical circuit, the switch can complete the circuitry which can, in turn, activate an alarm, a signal device, a land mine or any other appropriate apparatus. As will be more fully developed later in the specification, and thus more clearly appreciated, the invention is particularly well suited for use as an electrical switch in situations where it is desired to detect specific activity within, or over, an extended area. Also, depending on the environment in which the invention is to be used, the invention in another embodiment may include protective layers which can be placed over the conductive layers on the sides opposite the insulative layer. In any event, and regardless of its specific embodiment, the invention is primarily intended for use as an electrical switch that is adaptible as a flexible continuum in a wide variety of applications.

The specific nature of the invention and its novel features, as well as other objects, uses and advantages thereof, will clearly appear from the accompanying drawings, taken in conjunction with the accompanying description, in which similar reference characters refer to similar parts and in which:

DESCRIPTION OF THE PREFFERED EMBODIMENTS

Figure 1:
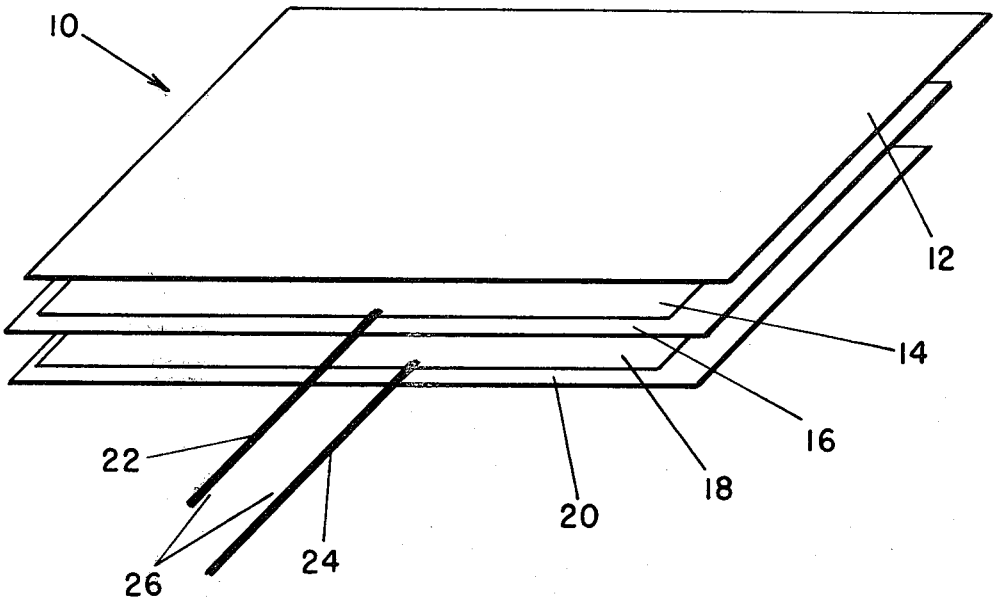
FIG. 1 is an exploded perspective view of the invention.

Referring now to FIG. 1, it can be clearly seen, in more detail, that switch 10 comprises an insulator 16 which electrically separates a conductor 14 from another conductor 18. Although it is not essential to the practice of this invention, the conductors 14 and 18 may be glued, or otherwise fixedly attached, to the insulator 16 to prevent relative motion between these elements. Also, protective sheet 12 and protective sheet 20 may be placed over the conductors 14 and 18 as shown in FIG. 1. Thus used, the protective sheets 12,20 will be useful for retarding weather deterioration of the conductors 14,18 and for preventing premature rupture of the switch 10. As with the connection between the insulator 16 and the conductors 14,18 glue or another form of adhesive may be used to attach the protective sheets 12,20 to the respective conductors 14,18. Although the following range of values are not inclusive, it is known that insulator 16, conductors 14,18 and protective sheets 12,20 are operable when their thicknesses are in the range of 0.005 inch to 0.015 inch. It must be appreciated, however, that the thickness and constitution of any layer will depend upon the environment in which the switch 10 is to be used and the nature of the force which will activate the switch 10.

Figure 2:
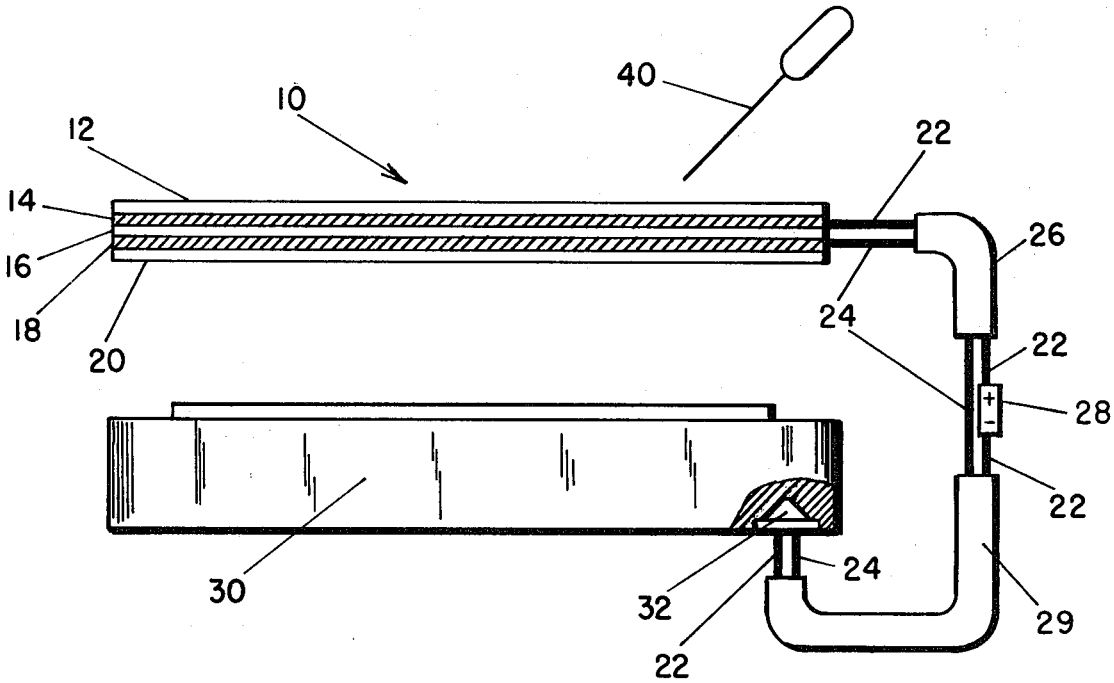
FIG. 2 is a side elevational view of the invention employed in conjunction with a land mine.

Still referring to FIG. 1, it can be seen that a wire 26 comprises a lead 22 and another lead 24 which are electrically insulated from each other. As shown in FIG. 1 and FIG. 2 wire 26 is constructed so that lead 22 is electrically connected to conductor 14 and lead 24 is electrically connected to conductor 18. During operation of the invention wire 26 will be connected to a source of potential, such as the power supply 28 shown in FIG. 2, to establish a difference in voltage potential between conductor 14 and conductor 18. Continuation of the unactivated electrical circuitry, external to switch 10, merely requires an appropriate series connection in a manner well known in the art. For instance, the wire 29 can be used to connect the power supply 28 with any desired electrically activated device. FIG. 2 shows a blasting cap 32 as merely one example of an electrically activated device which might be used as part of the circuitry external to switch 10.

Figure 3:
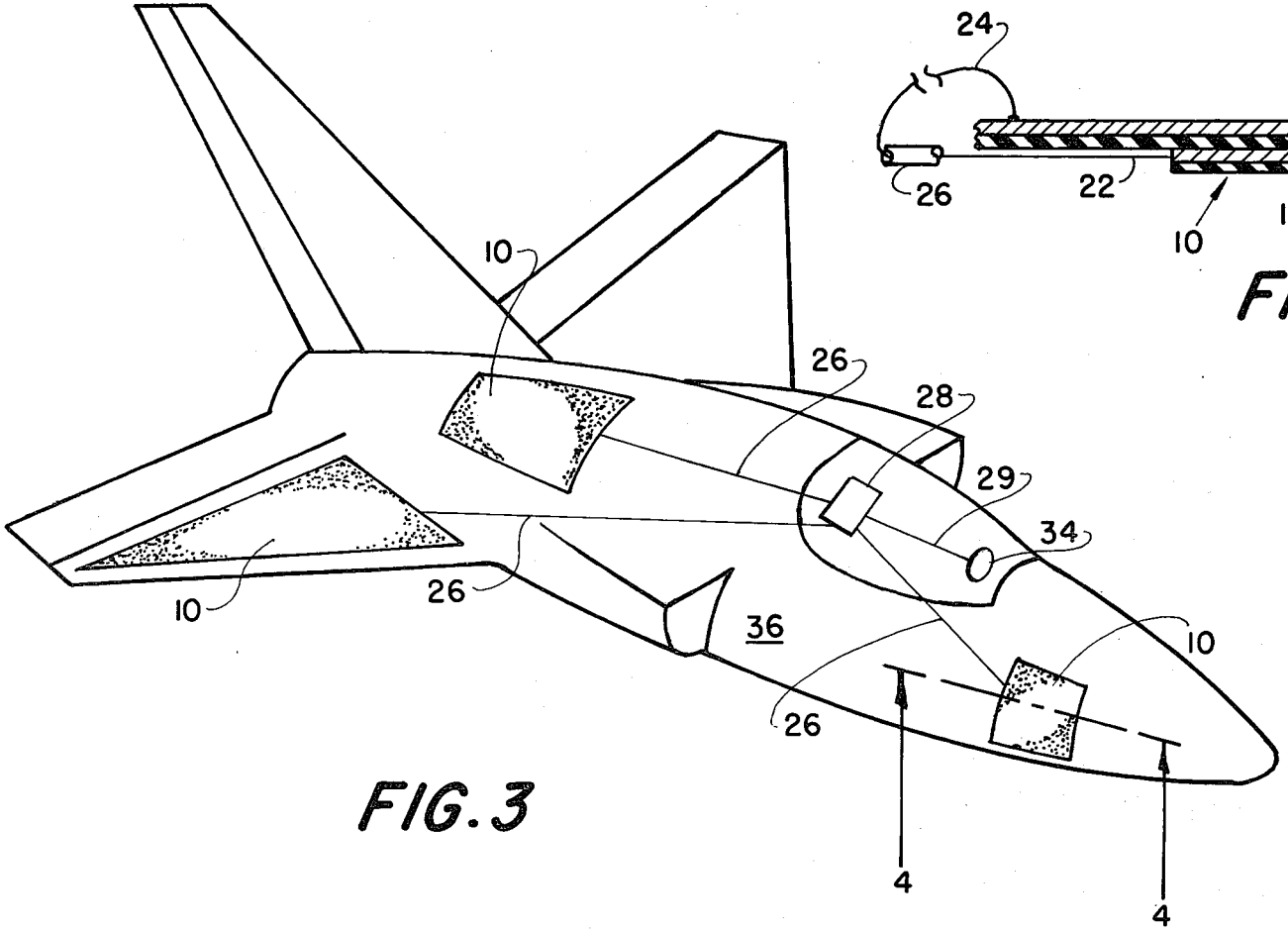
FIG. 3 shows a potential employment of the invention in an aircraft system.

Switch 10 can be used in several different configurations for several different purposes. FIG. 3, for example, shows an employment of a plurality of the inventions cooperatively associated as a damage assessment system on an aircraft 36. In this particular embodiment, whenever any of the switches 10 have been ruptured or broken a display 34 mounted in the aircraft 36 is activated to provide the pilot with visual indications damage has occurred.

Operation and use of the invention in the above described embodiments, as well as in any other application of the invention, depends on contact between conductor 14 and conductor 18 to complete the circuitry external to switch 10. The means for causing this contact will vary depending on the employment of the invention. In FIG. 2, the switch is shown in conjunction with a land mine. In this embodiment, it is envisioned that the switch 10 would comprise a continuous sheet and be employed as now described. First, switch 10 is attached to power source 28 by means of wire 26. The continuity of insulator 16 in switch 10 is then tested to ensure that switch 10 is open. This can be done by connecting into the switch 10 power source 28 circuit any electrical continuity testing device known in the art, such as a galvanometer. If insulator 16 is a continuum, and accordingly no electrical current is flowing through switch 10, the galvanometer should so indicate. The galvanometer can then be removed and the apparatus may be further assembled. Power source 28 is connected to wire 26 and to wire 29 in series through lead 22, as is best seen in FIG. 2. Blasting cap 32 is then attached to wire 29. A note of caution must be made at this point. Although insulator 16 was previously tested and found to be a continuum, it may still be possible that with power source 28 now in the circuit there is sufficient current to detonate blasting cap 32. Therefore, mine 30 must not be connected into the circuit until after blasting cap 32 has been connected in circuitry with switch 10 power source 28 and it is ascertained that blasting cap 32 is not thereby prematurely activated. Blasting cap 32 may now be connected to mine 30 and the entire apparatus emplaced for operation.

In operation, mine 30 is placed in the ground and covered with earth. Next, switch 10 is placed above the mine 30 and extended to cover the area above the mine 30. The entire assemblage, including power source 28 and its connecting wires 26,29, is covered with earth.

In the above described employment, the switch 10 and its associated circuitry would not interfere with the designed method for pressure detonation of the mine. On the other hand, absent such pressure, the mine would still detonate should a probe 40 (such as a stick, a bayonet, or a rod) puncture the switch 10 and cause contact between the conductors 14 and 18. As can be clearly seen by the circuitry configured in FIG. 2 contact between conductors 14 and 18 would complete the circuit and allow the power supply 28 to activate the blasting cap 32 and cause detonation of the land mine 30.

In another embodiment of the invention, the switch 10 can be employed together with other similar switches 10 to form a system. Individual switches 10 can be dispersed or placed side-by-side according to the need. With either configuration it would be possible to determine which, if any, of the total number of switches 10 may have been closed by whatever means. It should also be noted that a heat-sensitive insulator 16 may be chosen so that an elevated temperature may cause destruction or deformation of the insulator and thereby allow contact between conductors 14 and 18 to complete an external circuit.

Figure 4:
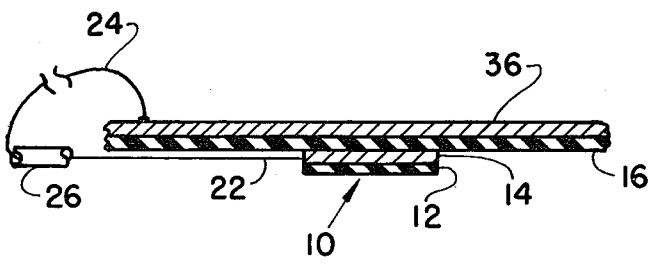
FIG. 4 is a fragmentary cross-sectional view taken along the plane 4—4 of FIG. 3, and viewed in the direction indicated by the arrows.

In yet another embodiment of the invention it is possible that the barrier or surface to be protected by use of the switch is, itself, a conductive material. In this case the insulator 16 can be placed directly against the surface of the aircraft 36, as shown in FIG. 4, and only one conductor 14 need be used. Lead 22 would then be electrically connected to conductor 14 and lead 24 would be electrically connected to the conductive surface of the aircraft 36. As in the other embodiments, insulator 16 must be employed to electrically separate the conductive materials. In this example insulator 16 would separate the conductive surface of the aircraft 36 from the conductor 14.

It is envisioned that some applications of the invention may require that the switch 10 cover an irregular surface. In such applications, the conductors 14,18 the insulator 16 and the protective sheets 12,20, if used, can be made of flexible and formable material. For example, the invention has been demonstrated operable with such material as a commercially available metal foil for the conductors 14 and 18 and a simple plastic sheet for the insulator 16 and the protective sheets 12 and 20. Regardless of construction, it must be appreciated that the actual materials used and the thickness of the conductors 14,18 the insulator 16 and the protective sheets 12,20 can be independently varied depending upon the intended use of the switch 10 and the environment in which it will be employed.

I claim:

1. A electrical switch comprising;

an electric insulator formed as a continuous sheet and adapted to be penetrated by a manually held probe, a first electrical conductor mounted on one side of said electric insulator, and a second electrical conductor similar to said first electrical conductor mounted on the opposite side of said electric insulator for causing contact between said first electrical conductor and said second electrical conductor, upon rupture of said insulator, to close said switch, said first and second electrical conductors comprising soft, flexible, metal foil adapted to be penetrated by a manually held probe.

2. An electrical switch as cited in claim 1 further comprising;

a first protective sheet attached to said first electrical conductor for enclosing said first electrical conductor between said electric insulator and said first protective sheet.

3. An electric switch as cited in claim 2 further comprising;

a second protective sheet attached to said second electrical conductor for enclosing said second electrical conductor between said electric insulator and said second protective sheet.

4. An electric switch comprising;

a structure having an electrically conductive surface, electric insulation means mounted on said surface, and a plurality of first flexible electrical conductors respectively mounted on said insulation means for causing contact between at least one of said first electrical conductors and said surface upon rupture of at least a portion of said insulation means, to close said switch, and means in circuit with each of said first elctrical conductor for indicating which of said first electrical conductors makes contact with said surface upon rupture of said insulation means.

5. An electrical switch as cited in claim 4 wherein said insulation means comprises a sheet for mounting on said surface.

6. An electrical switch as cited in claim 4 or claim 5 further comprising a plurality of first protective sheets attached respectively to said first electrical conductors for enclosing said first electrical conductors between said insulation means and said first protective sheets.

* * * * *